US005519926A

United States Patent [19]

Rosier

[11] Patent Number: 5,519,926

[45] Date of Patent: May 28, 1996

[54] NOSE ASSEMBLY FOR HYDRAULIC INSTALLATION TOOL

[75] Inventor: Hendrik E. Rosier, Kingston, N.Y.

[73] Assignee: Huck International, Inc., Irvine, Calif.

[21] Appl. No.: 239,539

[22] Filed: May 9, 1994

[51] Int. Cl.[6] ..... B21J 15/20

[52] U.S. Cl. ..... 29/243.523; 72/391.4; 29/243.529

[58] Field of Search ..... 72/391.4, 391.8; 29/243.522, 243.523, 243.524, 243.525, 243.529, 243.523

[56] References Cited

U.S. PATENT DOCUMENTS

| | | | |
|---|---|---|---|
| 3,107,806 | 10/1963 | Van Hecke et al. . | |
| 3,309,911 | 3/1967 | Simmons | 29/243.524 |
| 3,329,000 | 7/1967 | Schwab et al. . | |
| 3,362,211 | 1/1968 | Chirco . | |
| 3,446,509 | 5/1969 | Colosimo . | |
| 3,534,580 | 10/1970 | Chirco . | |
| 3,605,478 | 9/1971 | Chirco . | |
| 4,324,518 | 4/1982 | Dixon . | |
| 4,347,728 | 9/1982 | Smith . | |
| 4,580,435 | 4/1986 | Port et al. . | |
| 4,609,317 | 9/1986 | Dixon et al. . | |
| 4,627,775 | 12/1986 | Dixon . | |
| 4,750,347 | 6/1988 | Saarinen | 29/243.524 |
| 4,796,455 | 1/1989 | Rosier . | |
| 4,813,261 | 3/1989 | Rosier . | |
| 4,844,673 | 7/1989 | Kendall . | |
| 4,852,376 | 8/1989 | Suhov . | |
| 4,863,325 | 9/1989 | Smith . | |
| 4,878,372 | 11/1989 | Port et al. . | |
| 4,964,292 | 10/1990 | Kaelin . | |
| 5,090,852 | 2/1992 | Dixon . | |
| 5,119,554 | 6/1992 | Wilcox . | |
| 5,146,773 | 9/1992 | Rosier . | |

*Primary Examiner*—David Jones
*Attorney, Agent, or Firm*—Harness, Dickey & Pierce

[57] ABSTRACT

An installation tool installs multi-pieced fasteners having fastener components including a pin and a collar and/or sleeve by applying a relative axial force therebetween by a nose assembly which has a jaw structure for gripping the pin and an anvil for engaging the collar or sleeve. A first resilient spring structure is provided to exert an actuating bias on the jaw structure for gripping the pin while a second resilient, spring structure is provided to absorb shock loads experienced by the nose assembly during installation; the first and second resilient, spring structures are constructed to operate substantially independently of each other. A series of openings are provided at the forward end of the nose assembly to define a structure for expelling dirt and debris which would otherwise be trapped therein.

27 Claims, 3 Drawing Sheets

NOSE ASSEMBLY FOR HYDRAULIC INSTALLATION TOOL

SUMMARY BACKGROUND OF THE INVENTION

The present invention relates to tools for setting fasteners and more particularly to nose assemblies for installing pull type fasteners. Examples of such nose assemblies are shown in U.S. Pat. No. 3,107,806 issued Oct. 22, 1963 to Van Hecke et al for "Modified Nose Assembly", U.S. Pat. No. 4,347,728, issued Sep. 7, 1982 to Smith for "Apparatus And System For Setting Fasteners", U.S. Pat. No 5,119,554 issued Jun. 9, 1992 to Wilcox for "Pintail Ejector Assembly For Fastener Installation Tooling", and U.S. Pat. No. 5,146,773 issued Sep. 15, 1992 to Rosier for "Tapered Rotatable Offset Nose Assembly". As can be seen these nose assemblies are utilized in conjunction with a hydraulic and/or pneumatic power source for installing two piece fasteners by applying a relative axial pulling force, for example, between a pin or mandrel and a collar or sleeve. Examples of swage type fasteners, or lockbolts, employing a pin and collar and adapted to be set with a relative axial pulling force are shown in the '728 Smith patent, supra, U.S. Pat. No. 4,324,518, issued Apr. 13, 1992 to Dixon for "Dish Compensating Flush Head Fastener", and U.S. Pat. No. 5,090,852, issued Feb. 25, 1992 to Dixon for "High Strength Fastener And Method". Examples of blind type fasteners employing a pin and a sleeve and adapted to be set by a relative axial pulling force are shown in U.S. Pat. No. 4,627,775 issued Dec. 9, 1986 to Dixon for "Blind Fastener With Grip Compensating Means", U.S. Pat. No. 4,844,673, issued Jul. 4, 1989 to Kendall for "Lock Spindle Blind Bolt With Lock Collar Providing Pin Stop Support" and U.S. Pat. No. 4,863,325, issued Sep. 5, 1989 to Smith for "Two Piece Blind Fastener With Lock Spindle Construction". With both the swage and blind type fasteners, the pin has an elongated shank provided with a pintail or pull portion having a plurality of pull grooves adapted to be gripped by a plurality of chuck jaws in the nose assembly. The chuck jaws are normally resiliently biased towards a closed condition for engagement with the pull grooves such that, upon insertion of the pintail portion into the nose assembly and actuation of the tool, the pull grooves will be gripped by the chuck jaws. At the same time, however, in the deactuated condition, the chuck jaws will be normally held open against the resilient bias to facilitate insertion of the pintail portion into the aperture defined by the opened chuck jaws as well as ejection of the pintail portion after the fastener has been set.

An anvil member is adapted to engage the collar or sleeve, depending upon the type of fastener, and, upon actuation of the tool, the chuck jaws, as noted, are biased to their closed condition to grip the pintail portion of the pin shank and a relative axial pulling force is then applied between the engaged members of the fastener by way of the relative axial force between the chuck jaws and the anvil. Typically the pin or mandrel is also provided with a weakened portion or breakneck groove which is located on the shank of the pin between the pull or pintail portion and the remainder of the shank and is adapted to fracture at a preselected axial load, i.e. pin break load, after the fastener has been set. This results in a finally installed fastener having a generally flush and/or compact structure with minimal or no pintail protrusion.

The magnitude of the pin break load required to fracture the breakneck groove, however, can result in the transmission of significant reaction or shock loads to the nose assembly and more particularly to its internal structure including the chuck jaws and the resilient bias mechanism. The magnitude of pin break load can be especially high with swage type fasteners since the breakneck groove must be of sufficient strength to withstand the high installation loads required for the anvil to swage the collar onto the pin.

It has been a common practice in nose assembly designs to use a metal coil type spring to provide the resilient bias for actuating the chuck jaws (see '554 patent to Van Hecke, supra). The same spring, however, also fully receives the shock loads resulting from pin break. The continued, repetitive application of the shock load to the coil spring can result in wear and/or eventual reduction or loss of bias whereby the proper operation of the nose assembly could be impaired. On the other hand, a significant portion of the shock load, if not absorbed, may be transmitted to the operator.

In order to reduce the shock load experienced by the operator, nose assemblies were constructed using an elastomeric structure comprising a series of O-rings which were packed together to provide the resilient biasing action as well as an improved shock absorbing function; see for example the U.S. Pat. No. 3,446,509, issued May 27, 1969 to Colosimo for "Chuck Jaw", U.S. Pat. No. 3,534,580, issued Oct. 20, 1970 to Chirco for "Eccentric Riveting Tool", and U.S. Pat. No. 3,605,478, issued Sep. 20, 1971 to Chirco for "Integral Anvil Holder". In such constructions, however, the elastomeric material could be responsive to changes in temperature whereby the resilient bias force and shock absorbing resistance could vary. Also the build up of contamination and/or dirt could impair the operation of the O-ring assembly while, at the same time, the continuous, repetitive loading of the O-ring members could also eventually result in a reduction of the desired resilient bias applied to the chuck jaws.

Still another approach utilizes a combination of O-ring members and a coil spring placed in a series or aligned orientation. With this type of structure the coil spring is adapted to provide most of the resilient bias for the operation of the chuck jaws while the O-ring structure is adapted to provide most of the shock load absorption. With this series construction, however, the spring is substantially compressed and/or bottomed out in response to the full force of the pin break or shock load; thus, again, the problem of wear on the coil spring as a result of the heavy loads and changes in the load capability of the O-ring with temperature fluctuations could still result in undesired wear and functional variations.

Examples of installation tools with other shock absorbing constructions can be seen in the U.S. Pat. No. 4,878,372, issued Nov. 7, 1989 to Port et al for "Shock-Absorbing Fluid-Actuated Fastener Installation Tool" and U.S. Pat. No. 4,964,292, issued Oct. 23, 1990 to Kaelin et al for "Shock-Absorbing Fluid-Actuated Pressure System".

The present invention provides a nose assembly having a unique design in which a coil spring and assembly of O-ring members are utilized in a generally parallel combination in which the coil spring and O-ring members function substantially separately. In this construction the resilient bias required for the routine opening and closing function of the chuck jaws is provided substantially solely by the coil spring structure while the elastomeric O-ring members are used to provide substantially all of the shock or pin break load absorption with the coil spring being subject only to a small portion of the overall pin break load.

In addition the nose assembly of the present invention utilizes a unique construction in which dirt and debris introduced into the forward, open portion of the assembly is automatically expelled reducing the frequency with which the nose assembly has to be cleaned.

Thus it is an object of the present invention to provide a unique construction for a nose assembly for an installation for setting pull type fasteners.

Other objects, features, and advantages of the present invention will become apparent from the subsequent description and the appended claims, taken in conjunction with the accompanying drawings.

DETAILED DESCRIPTION OF A PREFERRED FORM OF THE INVENTION

Figure 1:
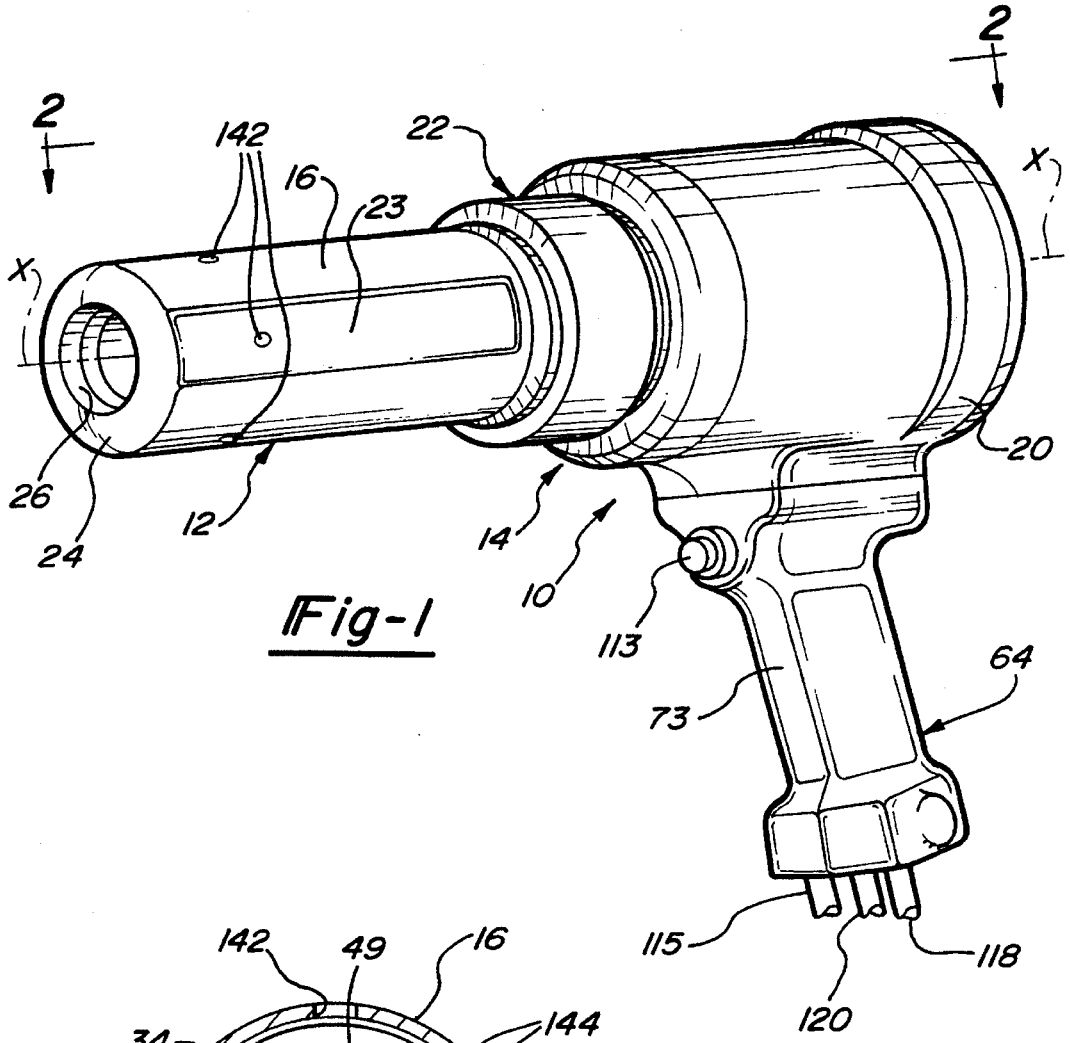
FIG. 1 is a pictorial view of an installation tool with a nose assembly embodying the features of the present invention.
Figure 4:
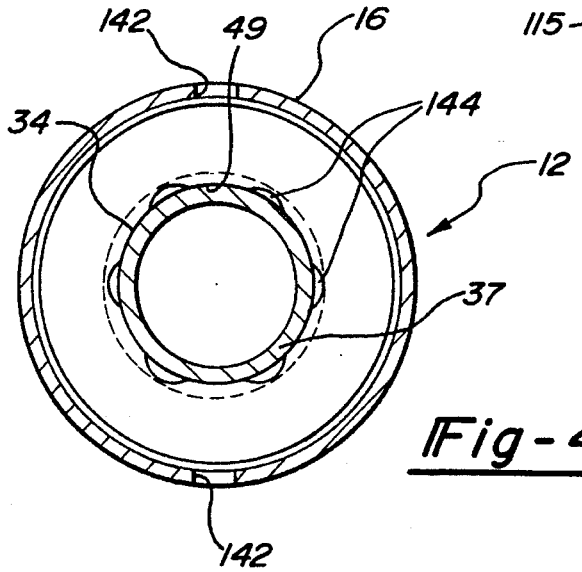
FIG. 4 is a sectional view of the nose assembly taken generally in the direction of the Arrows 4—4 in FIG. 3 and depicting the outer end of the collet with dirt expelling recesses.

Looking now to the drawings, an installation tool is generally indicated by the numeral 10 and includes a nose assembly 12 and a power cylinder assembly 14. The power cylinder assembly 14 can be of a generally conventional construction operable from a source of hydraulic pressure and is adapted to apply a relative axial force through the nose assembly 12 for setting multi-pieced fasteners such as the swage type and/or blind fasteners previously discussed.

The nose assembly 12 comprises a tubular generally cylindrically shaped anvil member 16 having an axially extending bore 18. The anvil member 16 is removably secured to the end of a cylinder housing 20 of the power cylinder assembly 14 by means of an adapter assembly 22, to be described. A pair of axially extending, diametrically opposite flats 23 on anvil member 16 (only one shown in FIG. 1) are provided to facilitate gripping of the nose assembly 12 with a wrench or other suitable tool. The rearward end of the anvil member 16, which is secured to the adapter assembly 22, is open while the opposite or forward end is substantially closed by an anvil portion 24 having a centrally disposed bore or aperture 26 located therein. In the embodiment shown, the bore 26 is configured to define a swage cavity adapted to perform a swaging operation on the collar of a swage type fastener in a manner known in the art; e.g. see the patents previously identified re swage type fasteners and related nose assemblies. It should be noted that while the nose assembly 12, as shown and described, is specifically configured for the installation of swage type fasteners, the features of the present invention can be utilized for nose assemblies for installing blind fasteners and other non-swage type which are installed by the application of a related axial pulling force and which receive a significant shock load during fastener installation.

A collet assembly 28 is located in the anvil member 16 and includes a generally tubular collet 30 which is slidably disposed in bore 18 in the anvil member 16.

A tubular collar ejector member 32 is axially, reciprocally movable partially within the bore or swage cavity 26 and is adapted to remove the anvil member 16 from the swaged collar of a fastener set by the installation tool 10. A chuck jaw release member 34 is of a stepped, generally tubular construction with an axially outer tubular portion 35 located within the collar ejector member 32 and an enlarged diameter tubular portion 37 slidably supported in a forward bore portion 49 of the collet 30. The jaw release member, which serves a purpose to be presently seen, has a flange 41 at its inner end which acts as a stop within the collet 30. The collet 30 is provided with a threaded bore 36 at its rearward end for threaded assembly onto the free end of a piston rod portion 38 of a pull piston 40 whereby the collet assembly 28 can be axially reciprocated by the pull piston 40 within the anvil member 16. The collet 30 is provided with a through bore having a frusto-conically shaped seat portion 42 at its forward end which is adapted to receive a chuck jaw assembly 44 which comprises a plurality of separate chuck jaw segments 45. Typically three separate chuck jaw segments 45 of substantially identical construction are employed, see for example the '509 Colosimo patent, supra.

Figure 2:
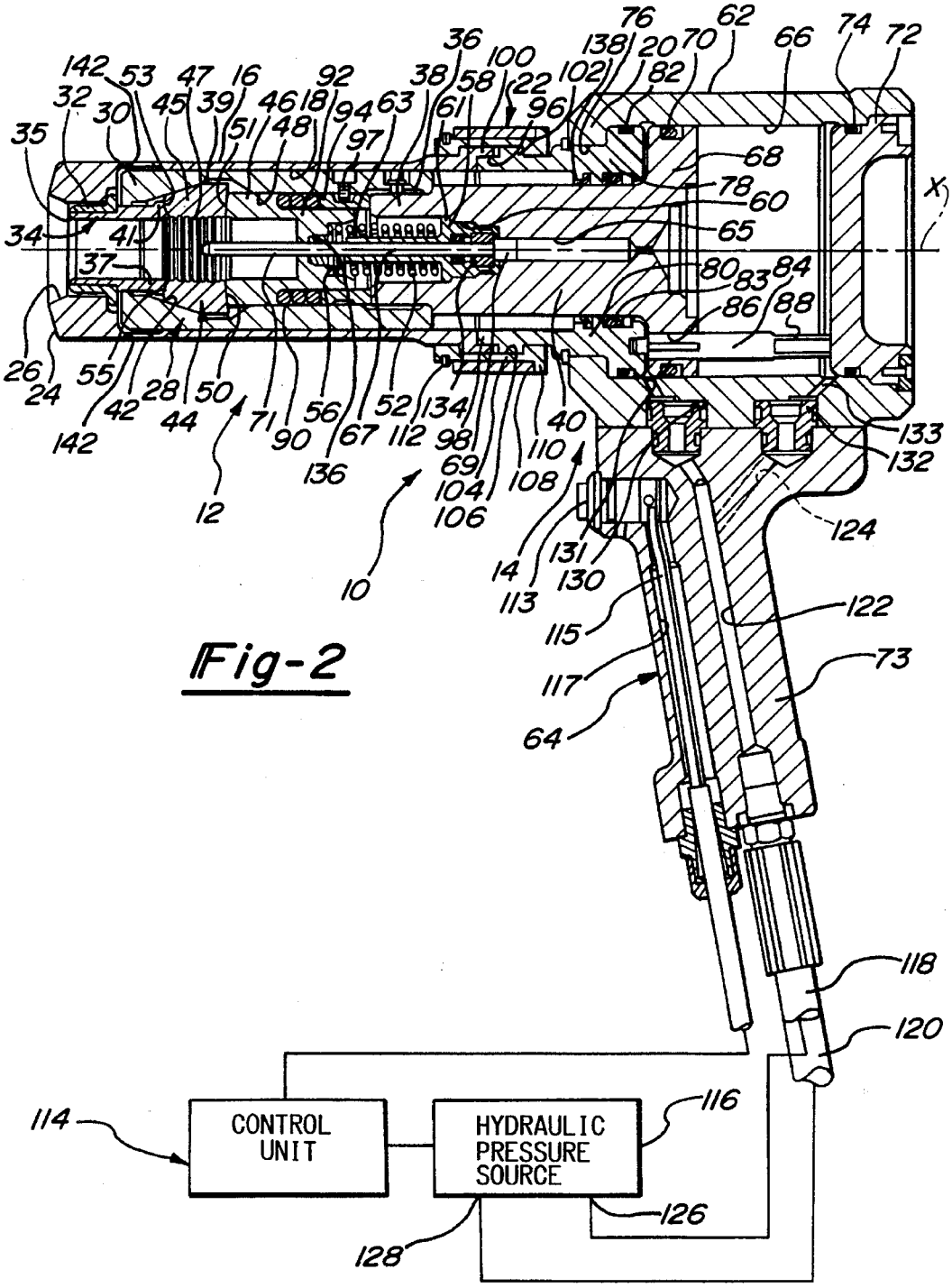
FIG. 2 is a side elevational, sectional view of the fastener installation tool of FIG. 1 taken generally in the direction of the Arrows 2—2 in FIG. 1 and substantially through the axis X with the nose assembly embodying the features of the present invention and with the installation tool with the nose assembly shown in the deactuated condition and including a control unit and hydraulic pressure source generally shown in block form.
Figure 3:
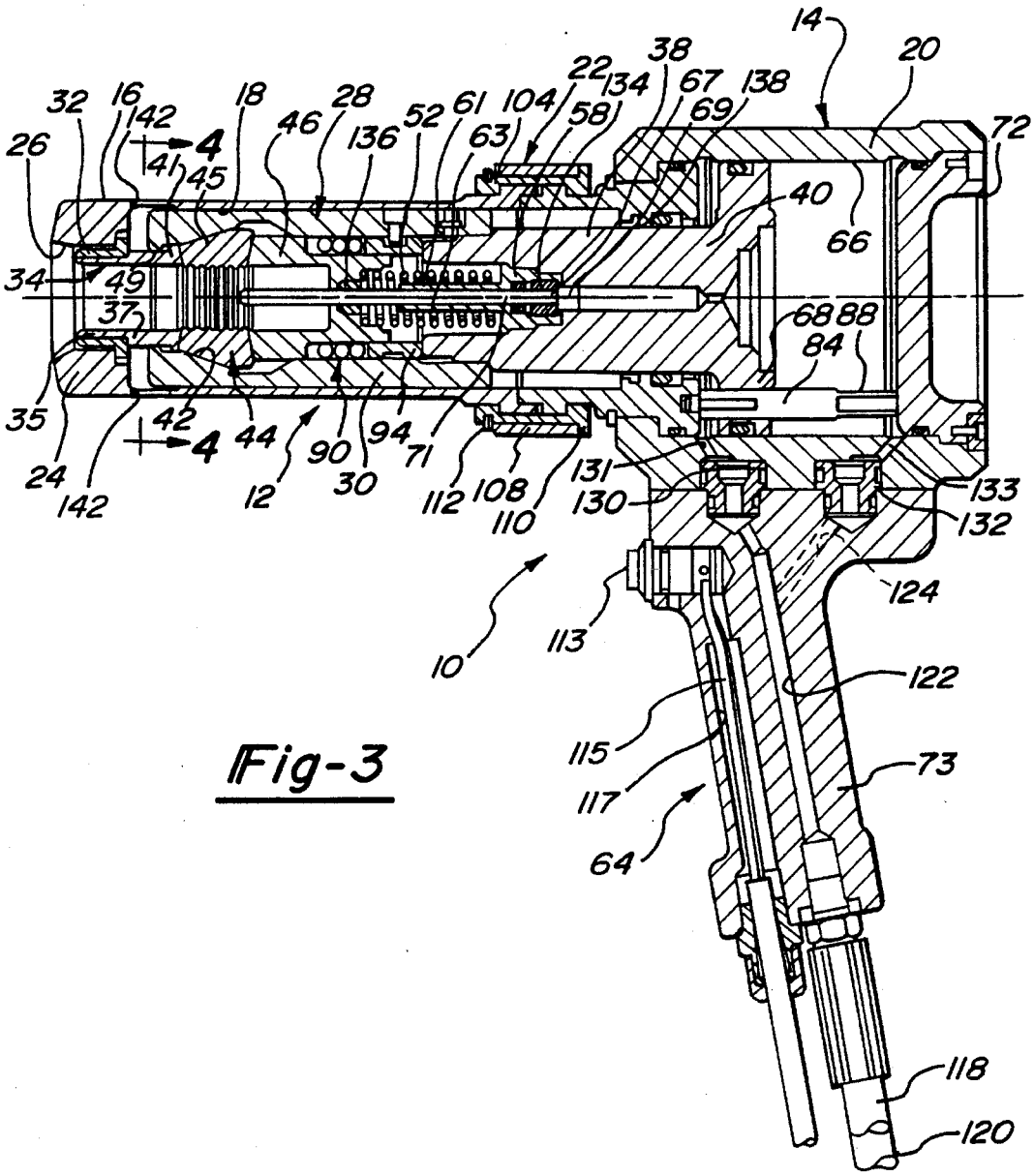
FIG. 3 is a view similar to that of FIG. 2 depicting the installation tool with the nose assembly in its initially actuated condition.

Thus in the embodiment of FIGS. 1–3, the chuck jaw assembly 44 is defined by three chuck jaw segments 45 which are of identical construction, being provided with radially outer surfaces 39 which together define a frusto-conical shape adapted to match that of the frusto-conical bore or seat portion 42. The jaw segments 45 are provided with a plurality of teeth 47 on their radially inner surfaces to provide means for gripping the pull grooves on the shank of the fastener pin in a manner well known in the art.

A chuck jaw follower 46 is slidably supported in a smooth, straight bore portion 48 of the through bore of the collet 30 and has a front end surface 51 adapted to engage rearward facing surfaces 50 on the jaw segments 45, for a purpose to be described. The jaw follower 46 is normally resiliently biased axially outwardly or forwardly by means of a first resilient structure in the form of a coil spring 52. The coil spring 52 has one end received within an enlarged bore 56 in the rearward end of the jaw follower 46. The opposite end of coil spring 52 is in engagement with an enlarged support head portion 58 of a tubular support member 61. The support head portion 58 is located in an axially extending piston counterbore 60 at the outer or free end of the piston rod portion 38. The support head portion 58 is of a stepped construction and is adapted to be snugly received within a similarly shaped end portion of the piston counterbore 60. The support member 61 has a reduced diameter extension portion 63 which extends forwardly through and slightly beyond the piston counterbore 60 and extends axially through the coil spring 52. The extension portion 63 acts as a locating or centering guide for the coil spring 52.

The coil spring 52, as assembled, is partially compressed to exert a preselected, resilient bias against the jaw follower 46 which in turn transfers the bias against the jaw segments 45 whereby front surfaces 55 of segments 45 are urged into engagement with a rearward end surface 53 of the jaw release member 34. As can be seen from FIGS. 2 and 3, the engaging surfaces 50 and 51 of the jaw segments 45 and of the jaw follower 46, respectively, are similarly inclined whereby the force exerted on the jaw segments 45 by the bias from the coil spring 52 urges the back end of jaw segments 45 radially outwardly. At the same time the engaging surfaces 53 and 55 on the jaw release member 34 and the jaw segments 45, respectively, are also similarly inclined to urge the front end of the jaw segments 45 radially outwardly. In this way the frusto-conical surfaces 39 on the jaw segments 45 are continuously urged radially outwardly into engagement with the mating frusto-conical seat portion 42 of the collet 30 whereby the jaw segments 45 are maintained in their desired positions in the deactuated and actuated conditions of the installation tool 10.

The pull piston 40 has a reduced diameter bore portion or passageway 65 which is in axial alignment with piston counterbore 60 to define an opening extending axially through the pull piston 40. A pintail ejector rod 67 has an ejector head portion 69 and an elongated, reduced diameter, ejector rod portion 71. The ejector head portion 69 is snugly, slidably supported in the reduced diameter bore portion 65 in pull piston 40 with the ejector rod portion 71 extending forwardly through the tubular support member 61 and partially into the opening defined by the chuck jaw assembly 44. The elongated ejector rod portion 71 is slidably supported within the extension portion 63 and functions in a manner to be described.

An annular outer seal in the support head portion 58 provides a radially outer hydraulic seal with a confronting portion of the piston counterbore 60 while an annular inner seal in the bore of the support head portion 58 provides a radially inner hydraulic seal with the elongated ejector rod portion 71.

The power cylinder assembly 14 includes a generally tubular cylinder housing 62 and a handle assembly 64 which is secured to the cylinder housing 62. The handle assembly 64 has an elongated downwardly extending handle 73 adapted to be gripped by hand by an operator. The cylinder housing 62 has a generally uniform cylinder bore 66 which is adapted to receive an enlarged piston head 68. The piston head 68 is adapted to be slidingly supported within the cylinder bore 66 with an annular seal 70 providing hydraulic sealing engagement between the piston head 68 and the confronting wall of the cylinder bore 66. A removable end cap 72 is located at the rearward end of the cylinder housing 62 to close that end of the cylinder bore 66 with an annular seal 74 providing a hydraulic seal therewith. The cylinder bore 66 terminates at its forward end in a reduced diameter cylinder bore portion 76. A cylindrical adapter sleeve 78 has a stepped outer construction with an enlarged flange 80 adapted to fit snugly within the cylinder bore 66 with an annular seal 82 providing a hydraulic seal therewith. At the same time an annular seal 83 supported in a circumferential groove in the adapter sleeve 78 provides a hydraulic seal with the piston rod portion 38.

The anvil member 16 has a stepped, outer construction at its rearward end with an enlarged bore 96 adapted to snugly receive a reduced diameter end portion 98 of the adapter sleeve 78. The anvil member 16 and adapter sleeve 78 have cooperating flanges 100 and 102, respectively, adjacent to each other. A diametrically split, two piece sleeve 104 has an enlarged annular inner bore 106 adapted to matably receive and capture the flanges 100 and 102. A one piece retaining ring 108 fits snugly over the two piece sleeve 104 to radially hold the two halves together. A flange 110 at the rearward end of the two piece sleeve 104 axially contains the retaining ring 108 at its rearward end while a snap ring 112 in an annular groove at the forward end of the two piece sleeve 104 axially contains the retaining ring 108 at its forward end.

An axially extending valve rod 84 is located in the cylinder bore 66 and extends through the piston head 68 via a bore 86 and defines a relief valve construction generally of the type shown and described in the U.S. Pat. No. 3,362,211 issued Jan. 9, 1968 to Chirco for "Tool Construction". The valve rod 84 has its rearward end axially supported against the inner wall of the end cap 72. The valve rod 84, which is generally circular in cross section, is located snugly, with a generally close tolerance clearance, within the similarly shaped support bore 86. Valve rod 84 terminates at its rearward end adjacent the end cap 72 in a valve portion 88 defined by a plurality of axially extending flats. As noted in the '211 Chirco patent, supra, this provides a means for relieving the high level of hydraulic pressure built up when the pull piston 40 reaches the end of its pull stroke, with the piston head 68 having bottomed out adjacent the end cap 72 and hence with the circular bore 86 then being in line with the flats on the valve portion 88.

In addition to the coil spring 52, a second resilient structure is provided which comprises a plurality of O-rings 90 which are supported within the collet bore portion 48 on a reduced diameter portion 92 at the rearward end of the jaw follower 46. An annular retaining ring 94 is held in the bore portion 48 by a set screw 97 extending radially through the collet 30 and into an annular groove in the retaining ring 94. The reduced diameter portion 92 of jaw follower 46 is slidably supported within the retaining ring 94.

The handle assembly 64 includes an electrical actuating switch 113 secured at the upper portion of the handle 73. Suitable electrical conductors 115 extend through an elongated bore 117 in handle 73 and are connected to the switch 113 at one end and at the opposite end to a control unit 114 for controlling a hydraulic pressure source 116 to actuate the power cylinder assembly 14. A pair of hydraulic lines 118 and 120 are connected at one of their ends to fluid passageways 122 and 124, respectively, in handle 73 and to ports 126 and 128, respectively, of the hydraulic pressure source 116 at their opposite ends.

The control unit 114 and hydraulic pressure source 116 can be of constructions known in the art, do not constitute a part of the present invention and hence the details thereof have been omitted for purposes of simplicity.

The hydraulic line 118 and passageway 122 are fluid communicated with the rod or pull side of cylinder bore 66 via a hydraulically sealed fitting 130 and passageway 131. The hydraulic line 120 and passageway 124 are fluid communicated with the piston head or return side of cylinder bore 66 via a hydraulically sealed fitting 132 and passageway 133.

Thus hydraulic line 118 is in fluid communication with the rod end of cylinder bore 66 via passageway 122, fitting 130 and passageway 131 while hydraulic line 120 is in fluid communication with the piston head end of cylinder bore 66 via passageway 124, fitting 132 and passageway 133.

The hydraulic pressure source 116 has a high pressure section for moving the pull piston 40 rearwardly in its setting stroke to set the fastener and an intermediate pressure section for returning the pull piston 40 forwardly to its original position after the fastener has been installed and a low pressure tank or return section which receives the hydraulic fluid displaced from the cylinder bore 66 during the high pressure setting stroke or the intermediate pressure return stroke.

The installation tool 10 will be normally in its deactuated condition as shown in FIG. 2. With the actuating switch 113 in its deactuated condition, i.e. when not depressed by the operator, the control unit 114 will condition the hydraulic pressure source 116 to connect the port 126 to the return or tank section and the port 128 to the intermediate pressure section which is at a hydraulic pressure higher than that at the return or tank section. In this condition the piston head side of cylinder bore 66 will be pressurized relative to the piston rod side of the bore 66 urging the pull piston 40 to its returned or deactuated position as shown in FIG. 2. At the same time, the pintail ejector rod 67 is urged to its forward position, as shown in FIG. 2, by the intermediate hydraulic pressure via passageway 65 acting on the ejector head portion 69. To actuate the installation tool 10, the operator simply depresses the actuating switch 113 which signals the control unit 114 to condition the hydraulic pressure source 116 to connect the port 126, and hence hydraulic line 118, to the high pressure section and to connect the port 128 and hydraulic line 120 to the return or tank section. In this condition, the rod end of the cylinder bore 66 will be connected to high hydraulic pressure section while the piston head end of the cylinder bore 66 will be connected to return or tank section.

As noted, the specific embodiment of the installation tool 10 shown in the drawings and described herein is for use in setting swage type fasteners or lockbolts generally of the type shown in the '852 and '518 patents to Dixon, supra. Details of such fasteners have been omitted for purposes of simplicity it being understood that reference to pins, collars and portions thereof are of the same type as those well known in the fastener art and as illustrated in the noted patents.

Thus in the deactuated condition of installation tool 10, as shown in FIG. 2, the chuck jaw assembly 44 is in its opened condition, i.e. the chuck jaw segments 45 are radially separated. In this condition, the shank of a pin of a swage type fastener can be inserted through the aperture or swage cavity 26 and into the opening defined by the radially separated chuck jaw segments 45. Upon actuation of the pull piston 40 rearwardly in its pull stroke, the collet 30 is moved rearwardly. As this occurs, the chuck jaw segments 45 remain axially fixed by virtue of their engagement with the follower 46 and the resilient bias of the coil spring 52. Thus as the collet 30 and its frusto-conical seat portion 42 move rearwardly, the jaw segments 45, by the resilient bias of coil spring 52 are moved radially inwardly to their radially closed position in which the jaw teeth 47 grip similarly shaped grooves on the pull portion of the pin shank of the fastener. With the jaw teeth 47 of jaw segments 45 gripping the pull grooves of the pin, the jaw assembly 44 will be located at its forward or closed position in the seat portion 42 and the adjacent side surfaces of the jaw segments 45 will be slightly spaced from each other. In this position the chuck jaw assembly 44 will define a generally circular aperture of around 360°. At this time the swage cavity 26 is engaged with the fastener collar which is located over the shank of the pin. The frusto-conically shaped surfaces 39 of the jaw segments 45 substantially match the contour of the frusto-conically shaped seat portion 42 whereby the chuck jaw segments 45 will be guided to maintain their inner surfaces and jaw teeth 47 in parallelism during axial forward and rearward movement resulting from actuation of the installation tool 10.

As noted a plurality of O-rings 90 also are constructed to coact with the chuck jaw assembly 44 through the jaw follower 46. In the installation tool 10 in its deactuated condition, the jaw segments 45 are held open by engagement of their front surfaces with the jaw release member 34. In this position, the coil spring 52 is compressed as a result of the axially rearward location of the jaw follower 46. In this condition the O-rings 90 are in a slight axial clearance with no compression or with only a slight or minimal compression. Now with the jaw assembly 44 in its open position the jaw teeth 47 are radially spaced sufficiently whereby the pull portion of the pin shank of a fastener can be freely inserted. In this condition, the pull piston 40 is urged to and held at its forward or return position by the relatively low, intermediate pressure from the intermediate pressure section of the hydraulic pressure source 116. At the same time the pintail ejector rod 67 is urged outwardly to its forward position by the intermediate pressure acting on the ejector head portion 69. The axial force required to overcome the holding pressure on the pintail ejector rod 67 and to move it axially rearwardly is of a relatively small magnitude such that insertion of the pull portion of the pin shank into the opening of the jaw assembly 44 is not impeded.

To set the fastener, the operator depresses the actuating switch 113 whereby the control unit 114 conditions the hydraulic pressure source 116 to connect the rod end of the cylinder bore 66 to the high pressure section and the piston head end of the cylinder bore 66 to the tank or return section. Now the pull piston 40 is moved axially rearwardly in response to the high hydraulic pressure being applied. As this occurs, the resilient bias of the coil spring 52 acts on the jaw follower 46 to move it forwardly against the jaw segments 45. At the same time the collet member 30 moves axially rearwardly with the pull piston 40 whereby the jaw segments 45 will be guided and moved radially inwardly by virtue of the matching engagement between the frusto-conical surfaces 39 on the jaw segments 45 and the frusto-conical surfaces on the collet seat portion 42. In this way the teeth 47 of the jaw segments 45 will engage the matching pull grooves on the pin shank. At the same time, the swage cavity 26 will engage the outer end of the collar. FIG. 3 illustrates the installation tool 10 in the beginning of the actuation or pull stroke in which the pull piston 40 has initially moved rearwardly whereby the jaw segments 45 have been moved to their radially closed positions. As the pull piston 40 is moved rearwardly, a relative axial force is applied between the pin and the collar and, upon its continued rearward axial movement, the swage cavity 26 will be moved to radially overengage the collar and to swage the collar into locking grooves in the shank of the pin. In this condition the collar ejector member 32 and jaw release member 34 are moved rearwardly out of the active portion of the swage cavity 26 by engagement with the swaged collar. As can be seen in FIG. 3, during the pull stroke the O-rings 90 are not compressively engaged and hence it is the bias of the coil spring 52 which is solely utilized to actuate the chuck jaw assembly 44 to its closed position to grip the pull portion of the pin shank.

After the completion of swage, the relative axial force continues to increase until a magnitude is attained at which the breakneck groove on the pin shank fractures separating the excess pull portion or pintail of the pin shank from the remainder of the pin shank. When this occurs, as previously noted, a shock load of considerable magnitude can result from the stored energy in the system causing the jaw assembly 44 to be thrust axially rearwardly against the jaw follower 46. Initially the coil spring 52 will be partially compressed generally to its original compressed condition as shown in FIG. 2. This compressive force absorbs only a small portion of the resultant shock load. At the same time, however, upon the rearward movement of the chuck jaw assembly 44, the jaw follow 46 compressively engages the resilient O-rings 90. As the O-rings 90 are compressed the shock load is essentially absorbed completing the swage portion of the installation of the fastener. In this regard the additional axial movement of the jaw follower 46 resulting from compression of the O-rings is relatively slight resulting in only a relatively moderate additional compression of the coil spring 52 beyond its normally compressed state. As can be seen compressive loads on the coil spring 52 are limited and at no time is the coil spring 52 actuated to its fully compressed condition in which it can no longer be compressed.

Next the installation tool 10 is returned to its original, deactuated condition by the operator releasing the actuating switch 113. In this condition, the control unit 114 conditions the hydraulic pressure source 116 to connect the rod end of the cylinder bore 66 to the tank or return section and the piston head end of the cylinder bore 66 to the intermediate pressure section. Now the pull piston 40 on its return stroke is moved axially forwardly to its original, axially forward position. As this occurs, collet 30 engages a flange on the collar ejector member 32 to thereby apply an axial force against the swaged collar whereby the swaged collar is ejected from the swage cavity 26. As noted the pintail portion of the pin shank has been severed and as such is held by the chuck jaw assembly 44. However, as the jaw assembly 44 is moved axially forwardly with the collet assembly 28 in the return stroke of pull piston 40 the jaw segments 45 are moved radially outwardly by engagement with the jaw release member 34 whereby the severed pintail portion is released. The pintail ejector rod 67, which is now under the intermediate, return pressure in the cylinder bore 66, is moved axially forwardly and engages the severed pintail portion ejecting it from the front end of the nose assembly 12.

After pin break and with the pull piston 40 in its fully actuated rearward position at the end of the pull stroke, the high pressure being applied during the pull stroke could increase to an undesirable level since the pull piston 40 is no longer moving. The potentially high pressure that could be built up in the rod end of cylinder bore 66 is relieved by way of the clearance between the flats of the valve rod 84 and the circular bore 86. In this position the valve portion 88 is, in a sense, actuated to permit high pressure fluid to flow from the rod end of the cylinder bore 66 to the piston head end and thereafter to the tank or return section of the hydraulic pressure source 116. This reduces the pressure at the rod end of the cylinder bore 66, inhibiting damage to the seals and/or related structure.

In order to prevent dirt and contaminants from accumulating on the pintail ejector rod portion 71 and related components an annular wiper 134 is located in a counterbore at the rearward end of the support head portion 58 of support member 61. The wiper engages the ejector rod portion 71 and provides a lubricating and cleaning action as the rod portion 71 is reciprocated axially during the actuation of the installation tool 10. This assists in keeping dirt and contamination from the hydraulic seals which seal the support head portion 58. A similar annular wiper 136 is located in a reduced diameter portion of the bore 56 in jaw follower 46 and it also receives the rod portion 71 and acts to clean and lubricate that portion whereby dirt and contamination are kept out from the spring pocket or bore 56 of the coil spring 52. For a similar purpose, an annular wiper 138 is located in the forward end of the adapter sleeve 78 and engages the piston rod portion 38 to prevent dirt and contamination from impairing the effectiveness of the hydraulic seal 83. The wipers 134, 136 138 can be of a conventional construction and made of a generally resilient, elastomeric material.

It can be seen that the area in the anvil member 16 between the collet 30 and the front, anvil portion 24 is generally enclosed. Similarly the area between the flange 41 of the jaw release member and the confronting end of the collet 30 is also generally enclosed. It has been found, however, that the continued operation of a nose assembly with such a structure could result in a build up of dirt and debris including lubricants, coating and plating materials, and the like which can be trapped within these enclosed areas. This build up could impair the operation of the nose assembly and hence require frequent, periodic disassembly for cleaning. In the nose assembly 10 of the present invention a construction is provided for expelling dirt entering the anvil member 16 and the collet 30. Thus the anvil member 16 is provided with a plurality of radially extending release bores 142 located generally in close proximity to the rearward extremity of the swage cavity 26 and which communicate the anvil bore 18 with the outside. In the embodiment shown, four release bores 142 are utilized and are circumferentially spaced in generally equal 90° increments. In addition the forward bore portion 49 of the collet 30 is formed with a plurality of circumferentially disposed radially outwardly extending scalloped portions 144. The scalloped portions 144 define clearance openings with the generally uniform outer surface 146 of the jaw release member 34. Thus as the collet assembly 28 and its individual components reciprocate during cyclic operation, dirt and debris which has entered the anvil member 16 and collet 30 will, to a significant extent, be expelled through the axially extending openings defined by scalloped portions 144 by the axially forward movement of the jaw release member 34 including the flange 41 and then out through the release bores 142 by the forward movement of the collet 30 to its return position as shown in FIG. 3.

As can be seen, the coil spring 52 and the O-rings 90 function substantially independently of each other. The coil spring 52 in providing the bias to the jaw segments 45 is operative from its substantially maximum compressed condition of FIG. 2 to its maximum extended or minimum compressed condition of FIG. 3. As discussed, the O-rings 90 are essentially of no functional effect if any during actuation of the coil spring 52 between these two operative positions. Even in response to the shock load, the coil spring 52 will be further compressed only a relatively small amount from its maximum compression as the O-rings are engaged by the jaw follower 46 and are in turn compressed in absorbing the shock load. Thus with such a construction, the magnitude of resilient bias provided by the coil spring 52 for actuation of the jaw segments 45 can be optimized with minimal, if any, consideration as to shock load absorption. Also the operation and durability of the coil spring 52 will be substantially unaffected by the shock loads. At the same time, the resilience of the O-rings 90 can be optimized for shock load absorption again with minimal, if any, consideration regarding the operating bias to be applied to the jaw segments 45. Thus variations in elasticity in the O-rings 90 resulting from temperature changes will not significantly impair the shock absorbing capability of O-rings 90 and, of course, will have essentially no effect on the coil spring 52 and/or the bias applied to jaw segments 45.

In one form of the installation tool 10, the nose assembly 12 was constructed for installation of a swage type fastener having a pin with nominal shank diameter of ⅞ inch. In this construction the minimum diameter of the opening defined by the jaw segments 45 in their fully opened position of FIG. 2 was around ⅞ inch with sufficient clearance to permit insertion of the pull portion of the pin shank. At the same time the minimum diameter of the swage cavity was around 1¼ inch. In one embodiment a die type spring made of metal wire with a rectangular cross section was used for coil spring 52. The coil spring 52 had an outside diameter of around ¾ inch and inside diameter of around ⅜ inch. The coil spring 52 had a free length of around 2 inches. In its substantially, maximum compressed condition of FIG. 2, the coil spring 52 had a compressed length of around 1⅝ inches and exerted a bias on the jaw follower 46 of approximately 50 pounds. In its lesser compressed condition of FIG. 3, the coil spring 52 had a compressed length of around 1⅞ inches and exerted a bias on the jaw follower 46 of approximately 22 pounds. With an installation tool 10 of such a construction for a pin having a nominal shank diameter of ⅞ inch, the O-rings 90 will deflect approximately 0.09 inches which will result in only approximately an additional 10 pounds of axial, compressive force applied to the coil spring 52. The shock load on the jaw assembly 44 and jaw follower 46, however, can reach a magnitude substantially greater than 60 pounds. Thus it can be seen that the force required to compress the coil spring 52 from its initial minimum compressed, bias condition to its operatively maximum compressed, bias condition is approximately 38 pounds which is generally the normal operating range of the coil spring 52. In addition, it can be seen then that the maximum shock load imposed on the coil spring 52 will be generally no greater than the maximum magnitude of compressive forces exerted in applying the operative bias on the jaw assembly 44.

The coil spring 52, constructed as described, when fully compacted, has a length of approximately ⅝ inch. Thus the maximum compressive load capability of the coil spring 52 from its relaxed, uncompressed state (2 inches) to its fully compacted state (⅝ inches) will be approximately 150 pounds. Thus the coil spring 52 will not be subjected to operating loads near its 150 pound, maximum load capability and in any event, the coil spring 52 will not be subjected to loads substantially greater than the normal, maximum operating load for which it was selected to provide the function of biasing the jaw assembly 44.

The O-rings 90 comprised three separate O-rings of a conventional construction of a suitable synthetic, elastomeric material. In one form of the invention the O-rings 90 were of a generally standard construction of Buna-N with a 92 durometer. Each of the O-rings had an outside diameter of around ¾ inch and inside diameter of ⅜ inch. The O-rings were of a circular cross-section with a diameter of around 3/16 inch each to thereby define the packed cluster of O-rings 90 to have an overall axial length of around ⅜ inch. While O-rings 90 are shown and described it is believed that other elastomeric constructions could be used to provide the cushioning effect to absorb the shock loads.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, the improvement comprising:

power means including a piston adapted for reciprocating axial movement and for providing a relative axial force during such axial movement, installation means including jaw means having opened and closed positions and adapted to grip the pull portion of the pin shank when in said closed position and to release the pull portion of the pin shank when in said opened position, said installation means further including anvil means adapted to engage the collar and/or sleeve of the fastener, said installation means being operatively connected to said piston of said power means for transmitting said relative axial force of said piston between said jaw means and said anvil for applying said predetermined relative axial force between the pin and collar and/or sleeve when said jaw means has gripped the pull portion of the pin shank and said anvil means is in engagement with the collar and/or sleeve of the fastener, said installation means including jaw actuating means operable for moving said jaw means to said opened and closed positions and including first resilient spring means operative on said jaw means for providing a continuous spring bias on said jaw means to move said jaw means to said closed position, said installation means including second resilient spring means operatively connected with said jaw means for absorbing shock loads received by said jaw means resulting from the setting of the fastener, said first resilient spring means and said second resilient spring means being separately operable with said first resilient spring means providing substantially all of the spring bias to move said jaw means to said closed position while receiving a first portion of the shock loads from the setting of the fastener resulting in a total load on said first resilient spring means generally no greater than the maximum magnitude of spring bias applied to said jaw means and with said second resilient spring means providing generally all of the spring resilience for absorbing the shock loads in excess of said first portion while providing generally no more than around a small portion of the spring bias effective to move said jaw means to said closed position.

2. The installation tool of claim 1 with said first resilient spring means being actuable between a first bias condition for exerting a first magnitude of spring bias to initially urge said jaw means to said closed position and to a second bias condition for exerting a second magnitude of spring bias on said jaw means while in said closed position with said first magnitude of spring bias being greater than said second magnitude of spring bias, said first resilient spring means receiving a magnitude of the shock load generally no greater than said second magnitude of spring bias.

3. The installation tool of claim 2 with said first resilient means comprising a coil spring.

4. The installation tool of claim 2 with said second resilient means comprising a construction of an elastomeric, compressible material.

5. The installation tool of claim 2 with said first resilient means comprising a coil spring and with said second resilient means comprising a plurality of elastomeric O-rings.

6. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, and with the pin shank adapted to fracture at a preselected magnitude of relative axial force substantially at the completion of the setting action whereby the pull portion is removed, the improvement comprising:

power means including a piston adapted for reciprocating axial movement and for providing a relative axial force during such axial movement, installation means including jaw means having opened and closed positions and adapted to grip the pull portion of the pin shank when in said closed position and to release the pull portion of the pin shank when in said opened position, said installation means further including anvil means adapted to engage the collar and/or sleeve of the fastener, said installation means being operatively connected to said piston of said power means for transmitting said relative axial force of said piston between said jaw means and said anvil for applying said predetermined relative axial force between the pin and collar and/or sleeve when said jaw means has gripped the pull portion of the pin shank and said anvil means is in engagement with the collar and/or sleeve of the fastener, said installation means including jaw actuating means operable for moving said jaw means to said opened and closed positions and including first resilient spring means operative on said jaw means for providing a continuous spring bias on said jaw means to move said jaw means to said closed position, said installation means including second resilient spring means operatively connected with said jaw means for absorbing the shock load resulting from the fracturing of the pin shank at the weakened section during the setting of the fastener, said first resilient spring means and said second resilient spring means being separately operable with said first resilient spring means providing substantially all of the spring bias to move said jaw means to said closed position while receiving only a first portion of the shock loads from fracturing of the pin shank resulting in a total load on said first resilient spring means generally no greater than the maximum magnitude of spring bias applied to said jaw means and with said second resilient spring means providing substantially all of the spring resilience for absorbing the shock loads in excess of said first portion while providing generally no more than around a small portion of the spring bias effective to move said jaw means to said closed position.

7. The installation tool of claim 6 with said first resilient spring means being actuable between a first bias condition for exerting a first magnitude of spring bias to initially urge said jaw means to said closed position and to a second bias condition for exerting a second magnitude of spring bias on said jaw means while in said closed position with said first magnitude of spring bias being greater than said second magnitude of spring bias, said first resilient spring means receiving a magnitude of the shock load generally no greater than said second magnitude of spring bias.

8. The installation tool of claim 7 with said first resilient means comprising a coil spring.

9. The installation tool of claim 7 with said second resilient means comprising a construction of an elastomeric, compressible material.

10. The installation tool of claim 7 with said first resilient means comprising a coil spring with said second resilient means comprising a plurality of elastomeric O-rings.

11. An installation tool for installing multipiece fasteners of the type including a pin and a collar with the pin having a shank with a pull portion and with the fastener adapted to be installed by the application of a first predetermined magnitude of relative axial force between the pin and the collar whereby the collar is swaged onto the pin shank, and with the pin shank having a weakened section adapted to fracture at a second predetermined magnitude of relative axial force after swaging of the collar whereby the pull portion is removed, the improvement comprising:

power means including a piston adapted for reciprocating axial movement and for providing a relative axial force during such axial movement, installation means including jaw means having opened and closed positions and adapted to grip the pull portion of the pin shank when in said closed position and to release the pull portion of the pin shank when in said opened position, said installation means further including anvil means comprising an anvil adapted to engage the collar of the fastener and to be moved axially over the collar to swage the collar onto the shank of the pin, said installation means being operatively connected to said piston of said power means for transmitting said relative axial force of said piston between said jaw means and said anvil for applying said first predetermined magnitude of relative axial force between the pin and collar when said jaw means has gripped the pull portion of the pin shank and said anvil is in engagement with the collar of the fastener to swage the collar onto the shank of the pin and for subsequently applying said second predetermined magnitude of relative axial force to fracture the pin shank at the weakened section, said installation means including jaw actuating means operable for moving said jaw means to said opened and closed positions and including first resilient spring means operative on said jaw means for providing a continuous spring bias on said jaw means to move said jaw means to said closed position, said installation means including second resilient spring means operatively connected with said jaw means for absorbing the shock load resulting from the fracturing of the pin shank at the weakened section during the setting of the fastener, said first resilient spring means and said second resilient spring means being separately operable with said first resilient spring means providing substantially all of the spring bias to move said jaw means to said closed position while receiving only a first portion of the shock loads from fracturing of the pin shank at the weakened section resulting in a total load on said first resilient spring means generally no greater than the maximum magnitude of spring bias applied to said jaw means and with said second resilient spring means providing generally all of the spring resilience for absorbing the shock loads in excess of said first portion while providing generally no more than around a small portion of the spring bias effective to move said jaw means to said closed position.

12. The installation tool of claim 11 with said first resilient spring means being actuable between a first bias condition for exerting a first magnitude of spring bias to initially urge said jaw means to said closed position and to a second bias condition for exerting a second magnitude of spring bias on said jaw means while in said closed position with said first magnitude of spring bias being greater than said second magnitude of spring bias, said first resilient spring means receiving a magnitude of the shock load generally no greater than said second magnitude of spring bias.

13. The installation tool of claim 12 with said first resilient means comprising a coil spring.

14. The installation tool of claim 12 with said second resilient means comprising a construction of an elastomeric, compressible material.

15. The installation tool of claim 12 with said first resilient means comprising a coil spring and with said second resilient means comprising a plurality of elastomeric O-rings.

16. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion with an opening at one end adapted to receive the shank of the pin, a collet assembly slidably supported in said anvil housing and connected to said piston for reciprocating axial movement therewith, said collet assembly having a collet and jaw means supported in said collet having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw means has gripped the pull portion of the pin shank and said anvil portion is in engagement with the collar and/or sleeve of the fastener, said collet assembly including jaw actuating means operable for moving said jaw means to said opened and closed positions and including first resilient spring means operative on said jaw means for providing a spring bias on said jaw means to move said jaw means to said closed position, said collet assembly including second resilient spring means operatively connected with said jaw means for absorbing shock loads resulting from the setting of the fastener, said first resilient spring means and said second resilient spring means being separately operable with said first resilient spring means providing substantially all of the spring bias to move said jaw means to said closed position while receiving a first portion of the shock loads from the setting of the fastener resulting in a total load on said first resilient spring means which is generally no greater than the maximum magnitude of spring bias applied to said jaw means and with said second resilient spring means providing generally all of the spring resilience for absorbing the shock loads in excess of said first portion while providing generally no more than around a small portion of the spring bias effective to move said jaw means to said closed position.

17. The installation tool of claim 16 with said first resilient spring means being actuable between a first bias condition for exerting a first magnitude of spring bias to initially urge said jaw means to said closed position and to a second bias condition for exerting a second magnitude of spring bias on said jaw means while in said closed position with said first magnitude of spring bias being greater than said second magnitude of spring bias, said first resilient spring means receiving a magnitude of the shock load generally no greater than said second magnitude of spring bias.

18. The installation tool of claim 17 with said first resilient means comprising a coil spring.

19. The installation tool of claim 17 with said second resilient means comprising a construction of an elastomeric, compressible material.

20. The installation tool of claim 17 with said first resilient means comprising a coil spring and with said second resilient means comprising a plurality of elastomeric O-rings.

21. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion at its forward end with an anvil opening adapted to receive the shank of the pin, a collet assembly slidably supported in said anvil housing and connected to said piston for reciprocating axial movement therewith, said collet assembly having a collet with a collet opening at its forward end and generally in axial alignment with said anvil opening and adapted to receive the shank of the pin, said collet assembly having jaw means including a plurality of jaw members supported in said collet and having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw members have gripped the pull portion of the pin shank and said anvil portion is in engagement with the collar and/or sleeve of the fastener, said collet assembly including jaw actuating means operable for moving said jaw members to said opened and closed positions and including first resilient spring means including a spring member operative on said jaw members for providing a spring bias to move said jaw members to said closed position, said collet assembly including second resilient spring means, including a resilient shock absorbing structure operatively connected with said jaw members for absorbing shock loads resulting from the setting of the fastener, said collet assembly including a jaw follower having one end operatively engageable with said jaw members and having the opposite end operatively engageable with said spring member and with said shock absorbing structure, said jaw follower having a first position for closing said jaw members and a second position for opening said jaw members, said jaw follower resiliently biased from said second position to said first position by said spring member with substantially no operative engagement with said shock absorbing structure and being movable from said first position to said second position against the bias of said spring member by the shock load and at said second position operatively engaging said shock absorbing structure, whereby the remainder and generally the major portion of the shock load is absorbed by said shock absorbing structure.

22. The installation tool of claim 21 with said spring member comprising a coil spring.

23. The installation tool of claim 21 with said shock absorbing structure comprising a construction of an elastomeric compressible material.

24. The installation tool of claim 21 with said spring member comprising a coil spring with said shock absorbing structure comprising a plurality of elastomeric O-rings.

25. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion at its forward end with an anvil opening adapted to receive the shank of the pin, a collet assembly slidably supported in said anvil housing and connected to said piston for reciprocating axial movement therewith, said collet assembly having a collet with a collet opening at its forward end and generally in axial alignment with said anvil opening and adapted to receive the shank of the pin, said collet assembly having jaw means including a plurality of jaw members supported in said collet and having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw members have gripped the pull portion of the pin shank and said anvil portion is in engagement with the collar and/or sleeve of the fastener, said collet assembly including jaw actuating means operable for moving said jaw members to said opened and closed positions and including first resilient spring means including a spring member operative on said jaw members for providing a spring bias to move said jaw members to said closed position, said collet assembly including second resilient spring means, including a resilient shock absorbing structure operatively connected with said jaw members for absorbing shock loads resulting from the setting of the fastener, said collet assembly including a jaw follower having one end operatively engageable with said jaw members and having the opposite end operatively engageable with said spring member and with said shock absorbing structure, said jaw follower having a first position for closing said jaw members and a second position for opening said jaw members, said jaw follower resiliently biased from said second position to said first position by said spring member with substantially no operative engagement with said shock absorbing structure and being movable from said first position to said second position against the bias of said spring member by the shock load and at said second position operatively engaging said shock absorbing structure, whereby the remainder of the shock load generally is absorbed by said shock absorbing structure, said anvil housing being of a generally closed tubular construction and having a plurality of radially extending release bores located proximate to said anvil portion and communicating the interior of said anvil housing with the outside, said collet opening communicating with an enlarged diameter bore extending in said collet in a stepped structure defining an interior radial wall, said collet assembly including a jaw release member having a tubular portion slidably supported in said collet opening for reciprocating movement within said collet opening and said anvil opening, said jaw release member having an enlarged flange at the interior end of said tubular portion being generally adjacent to and in confrontation with said radial wall of said collet, said enlarged flange being engageable with a forward surface of said jaw members and adapted to hold said jaw members opened against the bias of said spring member, said collet opening being generally circular for providing a generally mating surface with said tubular portion of said jaw release member, said collet opening having a plurality of circumferentially disposed enlarged diameter portions defining axially extending passageways with said tubular portion of said jaw release member, said axial passageways being adapted to expel dirt and debris from said collet into said anvil housing in response to reciprocating movement of said jaw release member and said jaw members in said collet and said release bores being adapted to expel dirt and debris from said anvil housing in response to reciprocating movement of said collet in said anvil housing.

26. An installation tool for installing multipiece fasteners of the type including a pin and a collar and/or sleeve with the pin having a shank with a pull portion and with the fastener adapted to be installed by the application of a predetermined relative axial force between the pin and the collar and/or sleeve, the improvement comprising:

a power cylinder assembly including a cylinder housing and a piston adapted for reciprocating axial movement in said cylinder housing and for providing a relative axial force during such axial movement, a nose assembly removably secured to said cylinder housing and having an anvil housing having an anvil portion at its forward end with an anvil opening adapted to receive the shank of the pin, a collet assembly slidably supported in said anvil housing and connected to said piston for reciprocating axial movement therewith, said anvil housing being of a generally closed tubular construction and having a plurality of radially extending release bores located proximate to said anvil portion and communicating the interior of said anvil housing with the outside, said collet assembly having a collet with a collet opening at its forward end and generally in axial alignment with said anvil opening and adapted to receive the shank of the pin, said collet assembly having jaw means including a plurality of jaw members supported in said collet and having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said predetermined relative axial force between the pin and collar and/or sleeve when said jaw members have gripped the pull portion of the pin shank and said anvil portion is in engagement with the collar and/or sleeve of the fastener, said collet assembly including jaw actuating means operable for moving said jaw members to said opened and closed positions and including first resilient spring means including a spring member operative on said jaw members for providing a spring bias to move said jaw members to said closed position, said collet assembly including a jaw follower having one end operatively engageable with said jaw members and having the opposite end operatively engageable with said spring member, said jaw follower having a first position for closing said jaw members and a second position for opening said jaw members, said jaw follower resiliently biased from said second position to said first position by said spring member, said collet opening communicating with an enlarged diameter bore extending in said collet in a stepped structure defining an interior radial wall, said collet assembly including a jaw release member having a tubular portion slidably supported in said collet opening for reciprocating movement within said collet opening and said anvil opening, said jaw release member having an enlarged flange at the interior end of said tubular portion being generally adjacent to and in confrontation with said radial wall of said collet, said enlarged flange being engageable with a forward surface of said jaw members and adapted to hold said jaw members opened against the bias of said spring member, said collet opening being generally circular for providing a generally mating surface with said tubular portion of said jaw release member, said collet opening having a plurality of circumferentially disposed enlarged diameter portions defining axially extending passageways with said tubular portion of said jaw release member, said axial passageways being adapted to expel dirt and debris from said collet into said anvil housing in response to reciprocating movement of said jaw release member and said jaw members in said collet and said release bores being adapted to expel dirt and debris from said anvil housing in response to reciprocating movement of said collet in said anvil housing.

27. An installation tool for installing multipiece fasteners of the type including a pin and a collar with the pin having a shank with a pull portion and with the fastener adapted to be installed by the application of a first predetermined magnitude of relative axial force between the pin and the collar whereby the collar is swaged onto the pin shank and with the pin having a weakened section adapted to fracture at a second predetermined magnitude of relative axial force after swaging of the collar whereby the pull portion is removed, the improvement comprising:

a power cylinder assembly including a cylinder housing and a piston adapted for reciprocating axial movement in said cylinder housing and for providing a relative axial force during such axial movement in one direction for installing the fastener and in a reverse direction to return said piston to its original position, a nose assembly removably secured to said cylinder housing and having an anvil housing having an anvil portion at its forward end with an anvil opening adapted to receive the shank of the pin, a collet assembly slidably supported in said anvil housing and connected to said piston for reciprocating axial movement therewith, said anvil housing being of a generally closed tubular construction and having a plurality of radially extending release bores located proximate to said anvil portion and communicating the interior of said anvil housing with the outside, said collet assembly having a collet with a collet opening at its forward end and generally in axial alignment with said anvil opening and adapted to receive the shank of the pin, said collet assembly having jaw means including a plurality of jaw members supported in said collet and having opened and closed positions and adapted to grip the pull portion of the pin shank when in said closed position and to release the pull portion of the pin shank when in said opened position, said anvil portion adapted to engage the collar and/or sleeve of the fastener, said anvil housing and said collet assembly being operatively connected to said cylinder housing and to said piston for transmitting said relative axial force of said piston between said jaw means and said anvil portion of said anvil housing for applying said first predetermined magnitude of relative axial force in said direction between the pin and collar when said jaw members have gripped the pull portion of the pin shank and said anvil portion is in engagement with the collar to radially overengage said collar with said anvil opening to swage the collar onto the shank of the pin and for subsequently applying said second predetermined magnitude of relative axial force in said first direction to fracture the pin shank at the weakened section, said collet assembly including jaw actuating means operable for moving said jaw members to said opened and closed positions and including first resilient spring means including a spring member operative on said jaw members for providing a spring bias to move said jaw members to said closed position, said collet assembly including a jaw follower having one end operatively engageable with said jaw members and having the opposite end operatively engageable with said spring member, said jaw follower having a first position for closing said jaw members and a second position for opening said jaw members, said jaw follower resiliently biased from said second position to said first position by said spring member, said collet opening communicating with an enlarged diameter bore extending in said collet in a stepped structure defining an interior radial wall, said collet assembly including a jaw release member having a tubular portion slidably supported in said collet opening for reciprocating movement within said collet opening, said jaw release member having an enlarged flange at the interior end of said tubular portion being generally adjacent to and in confrontation with said radial wall of said collet, said collet assembly including a tubular collar ejector member connected with said jaw release member for relative movement within said anvil opening, said jaw release member being operative on said collar ejector member and responsive to said relative axial movement in said reverse direction to apply a third predetermined magnitude of relative axial force with said collar ejector against the swaged collar to remove the swaged collar from said anvil opening, said enlarged flange being engageable with a forward surface of said jaw members and adapted to hold said jaw members opened against the bias of said spring member, said collet opening being generally circular for providing a generally mating surface with said tubular portion of said jaw release member, said collet opening having a plurality of circumferentially disposed enlarged diameter portions defining axially extending passageways with said tubular portion of said jaw release member, said axial passageways being adapted to expel dirt and debris from said collet into said anvil housing in response to reciprocating movement of said jaw release member and said jaw members in said collet and said release bores being adapted to expel dirt and debris from said anvil housing in response to reciprocating movement of said collet in said anvil housing.

* * * * *